US006247281B1

(12) United States Patent
Lin

(10) Patent No.: US 6,247,281 B1
(45) Date of Patent: Jun. 19, 2001

(54) WALL PLANK STRUCTURE

(76) Inventor: Gary Lin, 9F, No. 35, An Ho Road, Taipei (TW)

( * ) Notice: Subject to any disclaimer, the term of this patent is extended or adjusted under 35 U.S.C. 154(b) by 0 days.

(21) Appl. No.: 09/389,100

(22) Filed: Sep. 2, 1999

(51) Int. Cl.[7] ..... E04C 1/00

(52) U.S. Cl. ..... 52/309.4; 52/792.1; 52/794.1; 52/592.4

(58) Field of Search ..... 52/309.4, 309.9, 52/592.4, 794.1, 792.1

(56) References Cited

U.S. PATENT DOCUMENTS 2,278,331 * 3/1942 Meyercord ..... 52/792.1 X
3,357,146 * 12/1967 Gartrell ..... 52/592.4
3,667,180 * 6/1972 Tischuk ..... 52/592.4 X
3,797,190 * 3/1974 Widdowson ..... 52/592.4
4,100,710 * 7/1978 Kowallik ..... 52/592.4 X
4,184,301 * 1/1980 Anderson et al. ..... 52/592.4 X
5,394,672 * 3/1995 Seem ..... 52/592.4 X
5,425,210 * 6/1995 Zafir ..... 52/592.4 X
5,678,369 * 10/1997 Ishikawa et al. ..... 52/791.1 X
5,842,315 * 12/1998 Lin ..... 52/792.1 X

* cited by examiner

*Primary Examiner*—Bruce A. Lev
(74) *Attorney, Agent, or Firm*—Bacon & Thomas

(57) ABSTRACT

A wall plank structure composed of an upper panel, a lower panel and an interconnecting layer interconnected therebetween and made of PU foaming agent. Two lateral sides of the upper and lower panels are respectively formed with left and right side walls which are continuously bent and respectively formed with a projection and a recess in the same direction for inserting with each other. The inner sides of the opposite left and right side walls of the upper and lower panels are disposed with adjoining layers formed of films for adjusting the distance between the upper and lower panels as necessary in the manufacturing procedure so as to obtain various thicknesses of the wall plank.

8 Claims, 8 Drawing Sheets

WALL PLANK STRUCTURE

BACKGROUND OF THE INVENTION

The present invention relates to a wall plank structure, the thickness of which can be adjusted according to actual requirement. The wall plank structure can be continuously mass-produced.

A conventional wall plank used in an iron sheet house, factory or warehouse is generally formed by an upper panel, a lower panel and a PU foam layer sandwiched thererbetween. In order to avoid spilling of the PU foam agent during the foaming procedure, two sides of the upper panel or lower panel are formed with perpendicularly extending left and right walls. In addition, in order to easily connect the wall planks with each other, the left and right side walls are formed with projections and recesses for inserting with each other.

According to the above structure, the wall plank is manufactured to have unified size and thickness so as to quickly mass-produce the wall plank by a machine. However, in working site, the limitation of the fixed size and thickness often causes trouble and inconvenience in working and leads to low working efficiency. Also, in the case that the wall plank is directly modified in the working site, the progress of the working will be affected.

Furthermore, in the conventional wall plank, the lateral walls (lateral connecting sections) are improperly designed so that when interconnected, a great gap often exists between the wall planks and water may leak through the gap. Moreover, The conventional wall plank is manufactured with unified size and thickness. When co-used and assembled with a C-shaped or H-shaped steel beam, it is often that the dimension of the wall plank cannot meet the dimension of the beam and the assembly is too loose or even it is impossible to assemble the wall plank with the beam.

SUMMARY OF THE INVENTION

It is therefore a primary object of the present invention to provide a wall plank structure in which the opposite left and right side walls of the upper and lower panels are disposed with adjoining layers formed of films, whereby in manufacturing procedure of the wall plank, the distance between the upper and lower panels can be adjusted as necessary so as to obtain various thickness of the wall plank.

It is a further object of the present invention to provide the above wall plank in which the left and right side walls of the upper and lower panels are respectively formed with a projection and a recess in the same direction for inserting with each other. The dimension of the recess of the side wall is slightly larger than the dimension of the projection of the side wall and a resilient pad member is disposed in the recess to reduce the possibility of leakage of water.

According to the above objects, the wall plank structure of the present invention is composed of an upper panel, a lower panel and an interconnecting layer made of PU foaming agent. The surfaces of the upper and lower panels are formed with channels. Two lateral sides of the upper and lower panels are formed with left and right side walls which are continuously bent and formed with a projection and a recess in the same direction for inserting with a mating recess and projection, respectively, of an adjacent panel. The inner sides of the opposite left and right side walls of the upper and lower panels are disposed with adjoining layers for adjusting the distance between the upper and lower panels in manufacturing procedure so as to obtain various thickness of the wall plank and achieve versatile application of the wall plank.

The present invention can be best understood through the following description and accompanying drawings wherein:

DETAILED DESCRIPTION OF THE PREFERRED EMBODIMENTS

Figure 1:
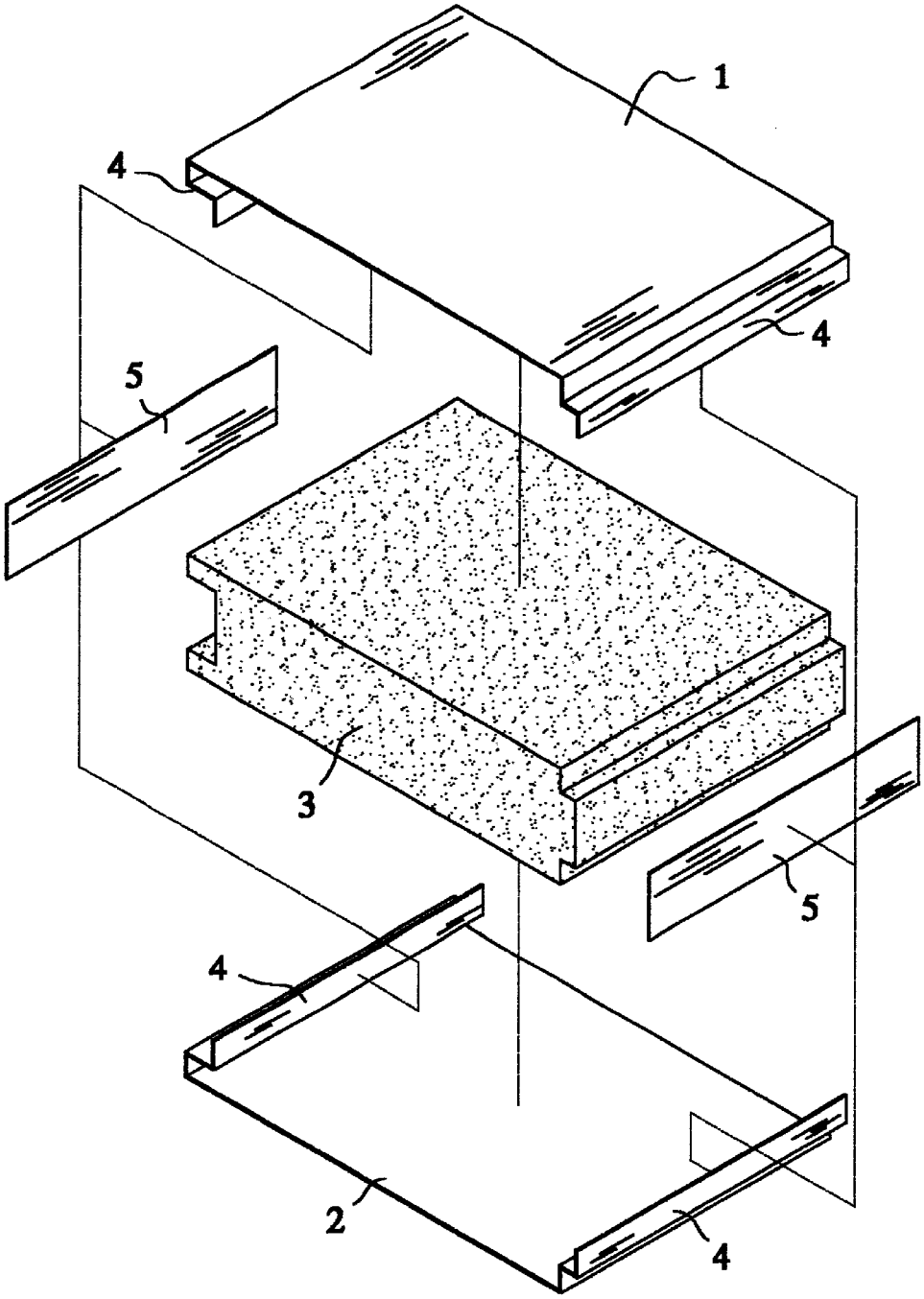
FIG. 1 is a perspective exploded view of the present invention.
Figure 2:
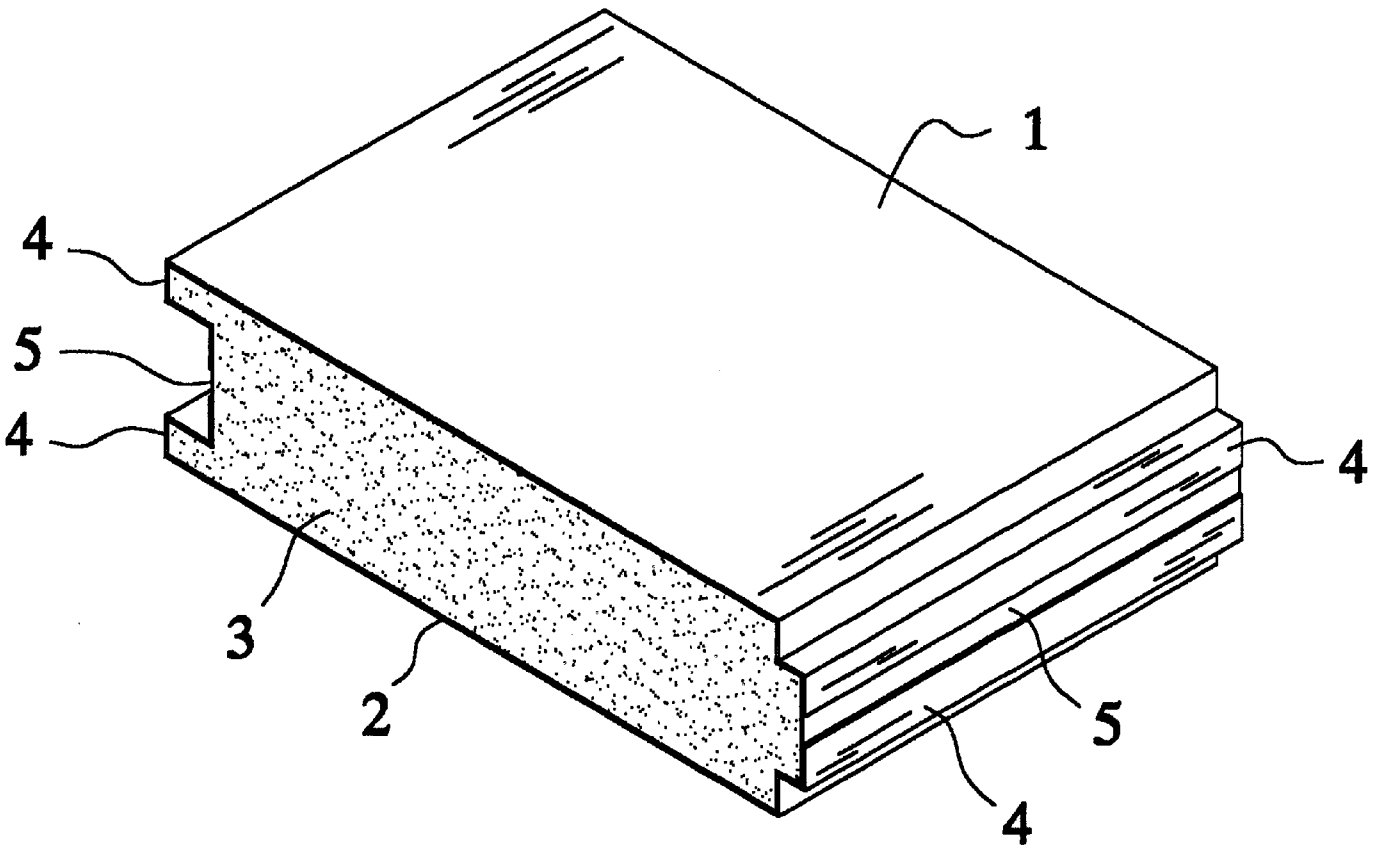
FIG. 2 is a perspective assembled view of the present invention.

Please refer to FIGS. 1 and 2. The wall plank of the present invention is formed by an upper panel 1, a lower panel 2 and an interconnecting layer 3 made of PU foaming agent. The material of the upper and lower panels 1, 2 can be light metal sheet, PVC (polyvinyl chloride), PC (polycarbonate), PP film, etc. Two lateral edges of the upper and lower panels are formed with left and right side walls 4 by bending. The left and right side walls 4 are respectively formed with a projection and a recess in the same direction. The recess has a dimension slightly larger than that of the projection. The inner side of the opposite left and right side walls 4 of the upper and lower panels 1, 2 are disposed with adjoining layers 5 made of film of PVC, nylon or wooden fiber sheet for adjusting the distance between the upper and lower panels 1, 2 to obtain the necessary thickness of wall plank. The upper and lower panels 1, 2, the left and right side walls and the adjoining layers 5 define a close space within which the PU foaming agent foams. The foaming agent serves to tightly associate the panels with each other to form a complete wall plank structure as shown in FIG. 2.

Figure 3:
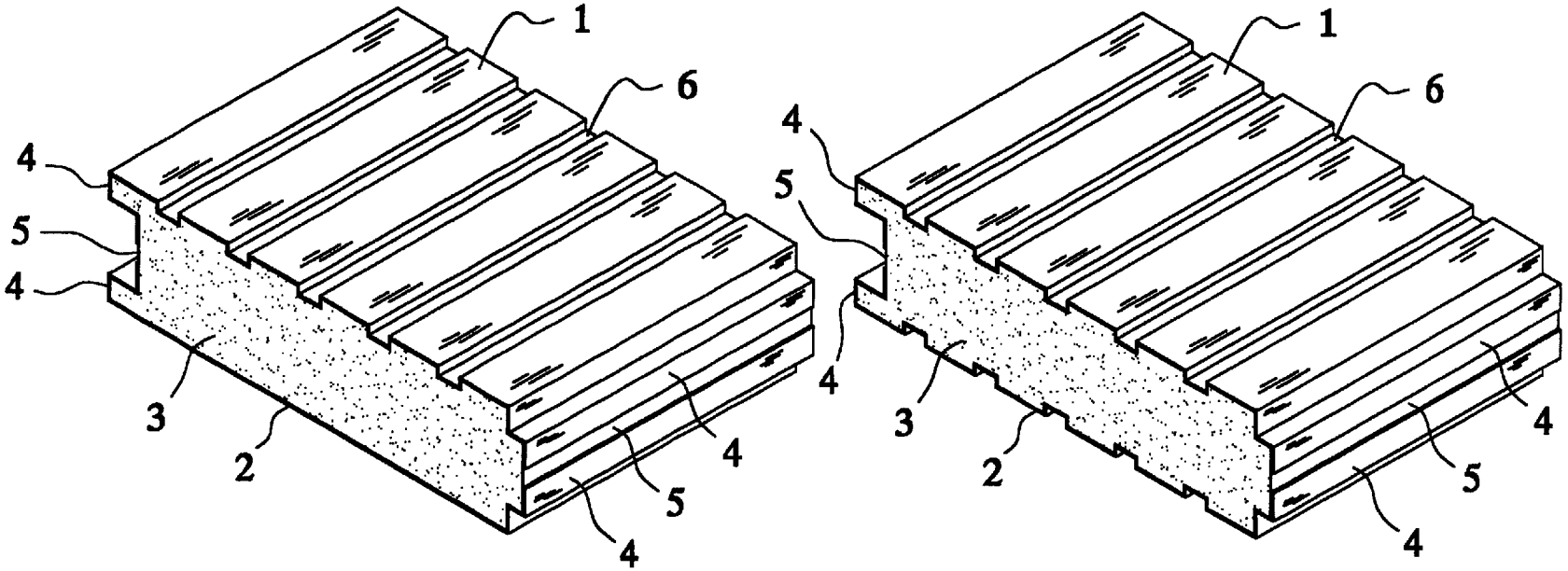
FIG. 3 shows two different embodiments of the present invention.

Referring to FIG. 3, in order to reinforce the wall plank, the surfaces of the upper panel 1 or lower panel 2 or both the upper and lower panels 1, 2 are formed with multiple parallel channels 6 which also achieve a draining effect.

Figure 4:
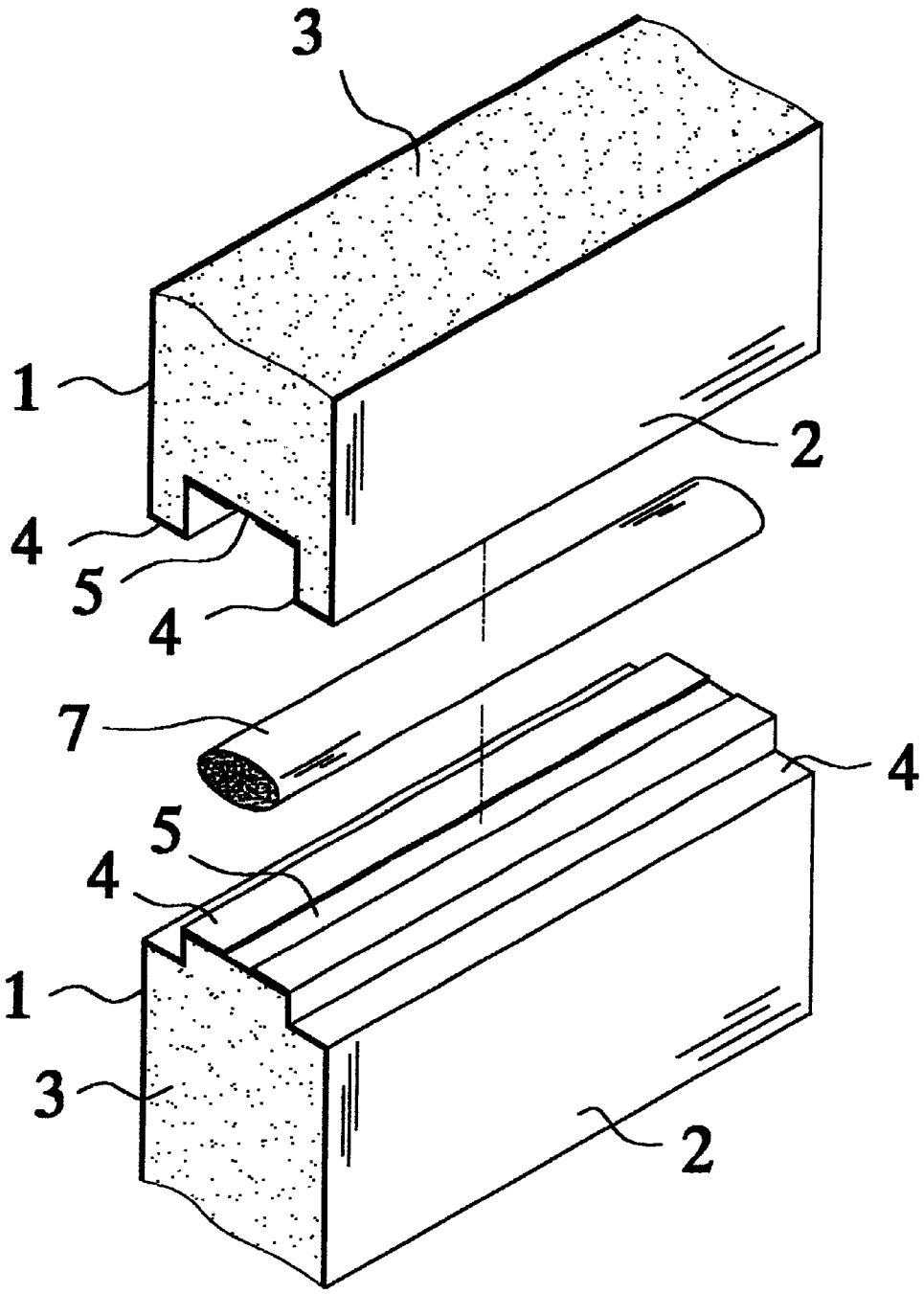
FIG. 4 shows that a resilient pad member is disposed between the recess and projection of two adjacent wall planks.
Figure 5:
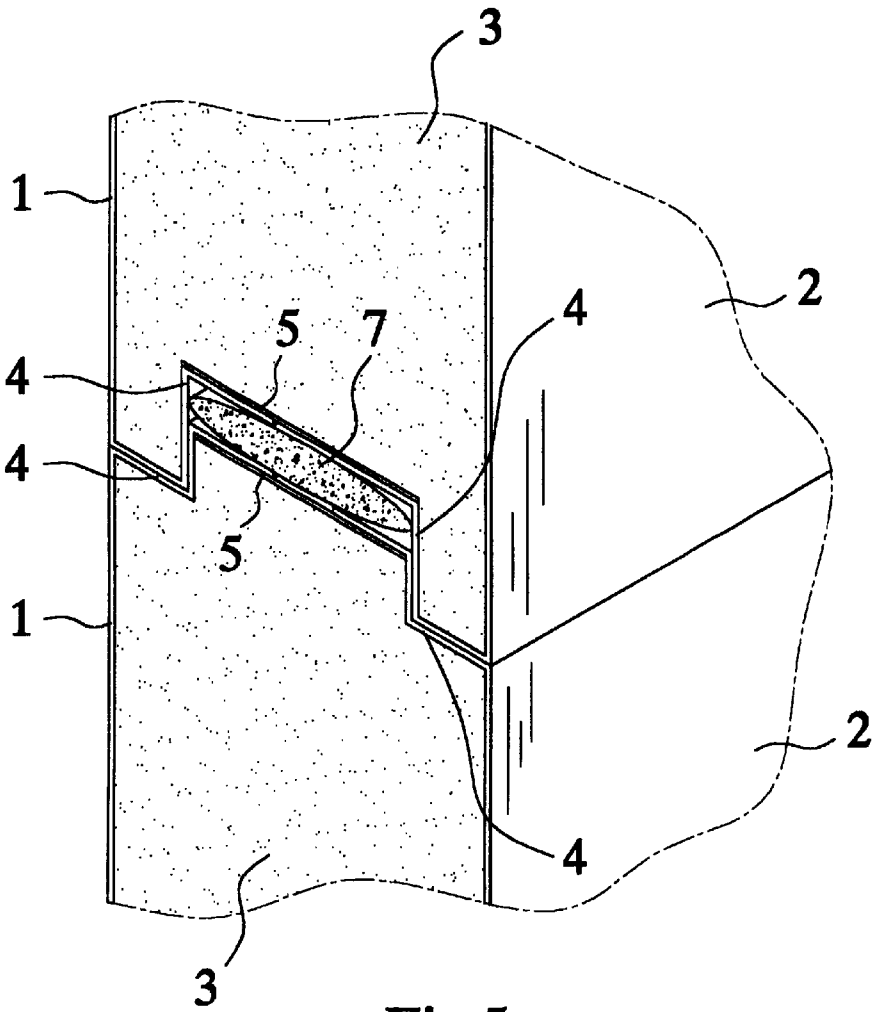
FIG. 5 is an enlarged assembled view of a part of the embodiment of FIG. 4.

In addition, as shown in FIG. 4, when overlapping and connecting the wall planks with each other, the side wall 4 of one wall plank with the projection is inserted with the side wall 4 of another wall plank with the recess. Also, a resilient pad member 7 is received in the recess of the side wall 4 for effectively reducing the possibility of leakage of water as shown in FIG. 5.

Figure 6:
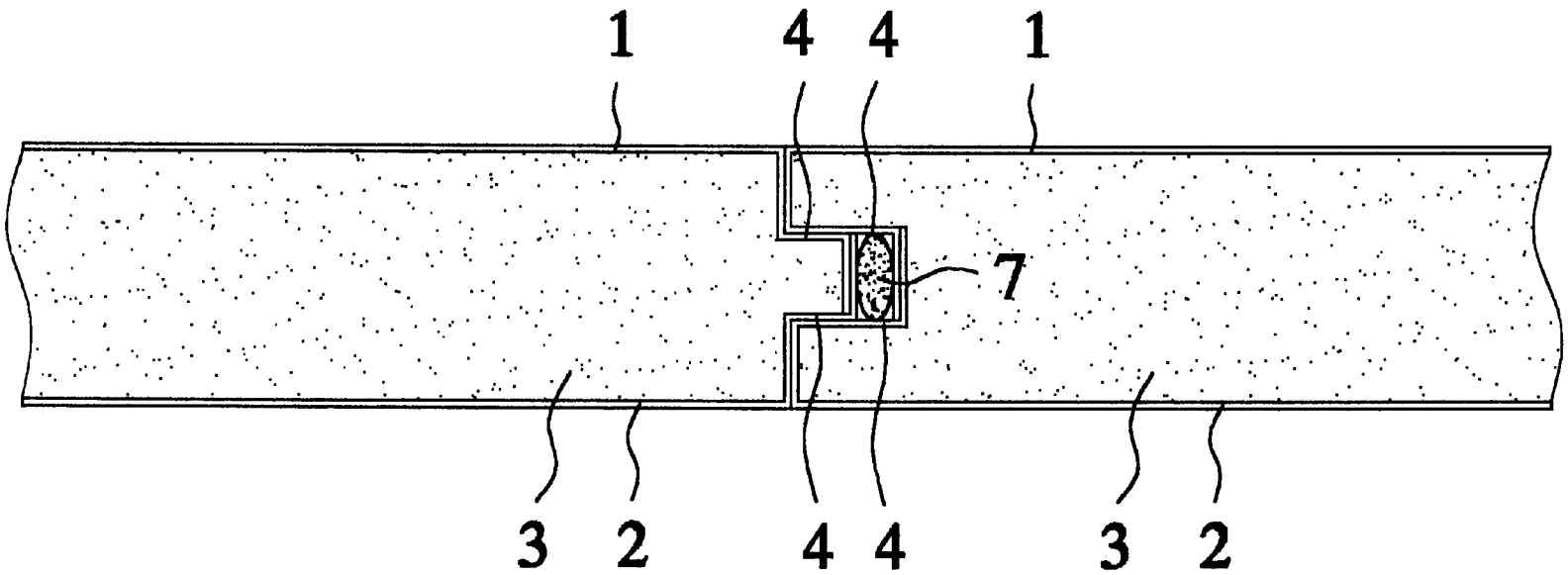
FIG. 6 is a sectional assembled view showing another embodiment of the present invention.

Furthermore, the upper and lower panels 1, 2 of the wall plank of the present invention are adjustable. In the case of maximum distance, the dimension of the adjoining layer 5 is increased. Reversely, in the case of minimum distance, the adjoining layer 5 is omitted and the opposite left and right side walls 4 of the upper and lower panels 1, 2 are directly overlapped as shown in FIG. 6.

Figure 7:
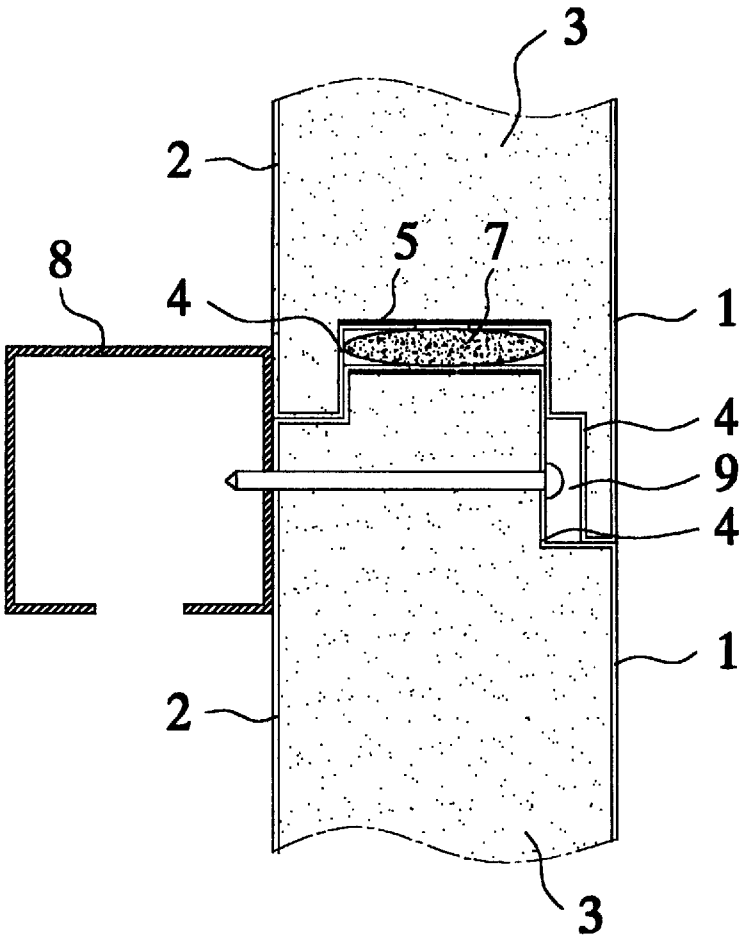
FIG. 7 shows that the wall plank of the present invention is co-used with a C-shaped steel beam.

In addition, when co-used with a C-shaped steel beam 8, as shown in FIG. 7, one side of the side wall 4 with the recess and an opposite side of the side wall 4 with the projection are connected to define a cavity 9 in which a bolt or a screw can be passed to combine the wall plank with the C-shaped steel beam 8.

Figure 8:
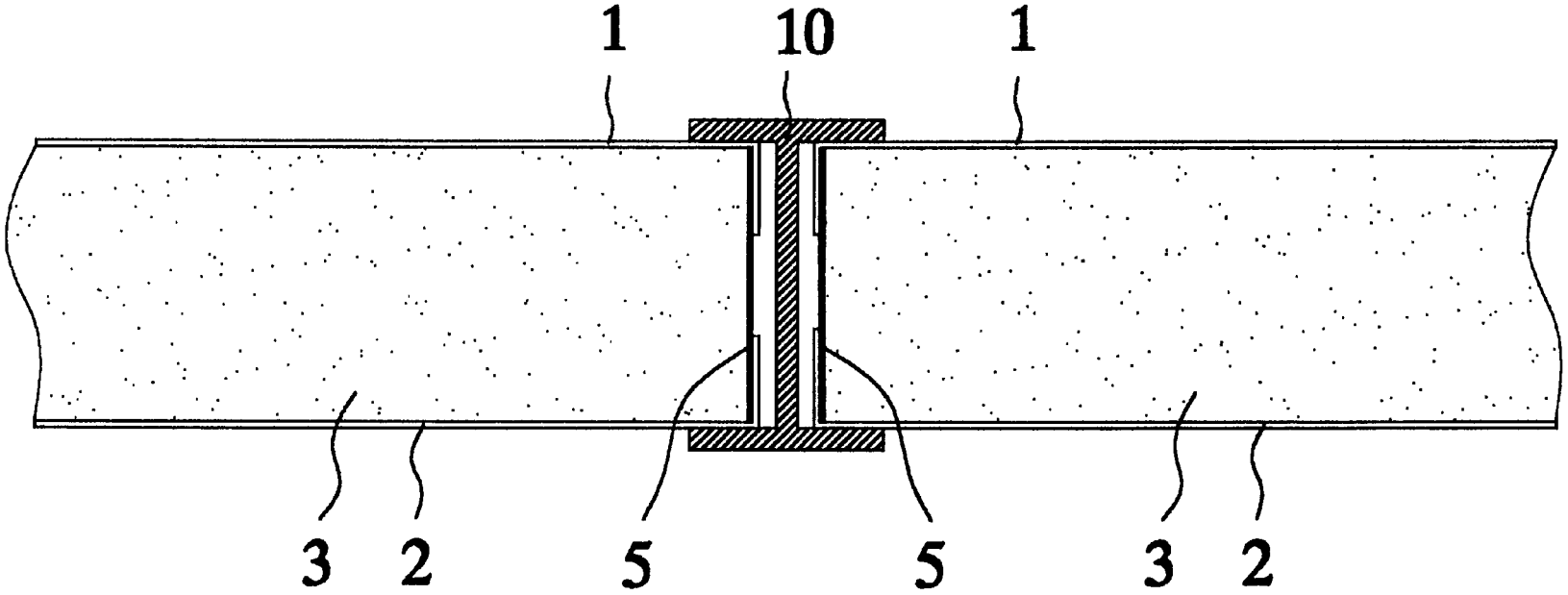
FIG. 8 shows that the wall plank of the present invention is co-used with an H-shaped steel beam.

Furthermore, as shown in FIG. 8, when co-used with an H-shaped steel beam 10, the H-shaped steel beam 10 serves to provide a better structural strength at the adjoining sections of the wall planks. In order to easily connect the wall plank with the H-shaped steel beam 10, two sides of the upper and lower panels 1, 2 are directly perpendicularly bent into a simple pattern. By means of the inner adjoining layer 5, the distance between the upper and lower panels 1, 2 can be adjusted so as to tightly mate with the H-shaped steel beam 10.

According to the above arrangement, the present invention has the following advantages:

1. The adjoining layer made of the film serves to adjust the distance between the upper and lower panels, whereby various thickness of wall planks can be achieved in accordance with actual requirement.
2. The dimension of the recess of the side wall is slightly larger than the dimension of the projection of the side, so that when overlapping and interconnecting the wall planks, a resilient pad member can be disposed at the adjoining sections for reducing possibility of leakage of water.
3. The wall plank of the present invention can be co-used with a C-shaped or an H-shaped steel beam to achieve versatile applications.

The above embodiments are only used to illustrate the present invention, not intended to limit the scope thereof. Many modifications of the above embodiments can be made without departing from the spirit of the present invention.

What is claimed is:

1. A wall plank structure comprising an upper panel, a lower panel and an interconnecting layer sandwiched therebetween and made of PU foaming agent, surfaces of the upper and lower panels being formed with channels, two lateral edges of the upper and lower panels being formed with left and right side walls which are bent and respectively formed with a projection and a recess in the same direction for inserting with each other, the inner sides of the opposite left and right side walls of the upper and lower panels being disposed with adjoining layers for adjusting the thickness of the wall plank.

2. A wall plank structure as claimed in claim 1, wherein the dimension of the recess of the side wall is slightly larger than the dimension of the projection of the side wall and a resilient pad member is disposed in the recess.

3. A wall plank structure as claimed in claim 1, wherein one side of the side wall with the recess and an opposite side of the side wall with the projection are configured so that inserting the projection of one wall plank structure into the recess of another wall plank structure defines a cavity in which a bolt or a screw can be passed to combine the wall plank with a C-shaped steel beam.

4. A wall plank structure comprising an upper panel, a lower panel and an interconnecting layer sandwiched therebetween and made of PU foaming agent, surfaces of the upper and lower panels being formed with channels, two sides of the upper and lower panels being directly perpendicularly bent to form simple plane left and right side walls, the inner sides of the opposite left and right side walls of the upper and lower panels being disposed with adjoining layers for adjusting the thickness of the wall plank so as to tightly mate with an H-shaped steel beam.

5. A wall plank structure comprising an upper panel, a lower panel and an interconnecting layer sandwiched therebetween and made of PU foaming agent, surfaces of the upper and lower panels being formed with channels, two lateral edges of the upper and lower panels being formed with left and right side walls which are bent and respectively formed with a projection and a recess in the same direction for inserting with each other, and said plank structure further including a pair of films which extend along the inner sides of the opposite left and right side walls of the upper and lower panels whereby the thickness of the wall plank is adjustable by selecting the dimension of said pair of films.

6. The wall plank structure of claim 5 wherein the dimension of the recess of the side wall is slightly larger than the dimension of the projection of the side wall and a resilient pad member is disposed in the recess.

7. The wall plank structure of claim 5 wherein one side of the side wall with the recess and an opposite side of the side wall with the projection are configured so that inserting the projection of one wall plank structure into the recess of another wall plank structure forms a cavity in which a bolt or screw can be passed to combine the wall plank with a C-shaped steel beam.

8. A wall plank structure comprising an upper panel, a lower panel and an interconnecting layer sandwiched therebetween and made of PU foaming agent, surfaces of the upper and lower panels being formed with channels, two sides of the upper and lower panels being directly perpendicularly bent to form simple plane left and right side walls, and said plank structure further including a pair of films which extend along the inner sides of the opposite left and right side walls of the upper and lower panels whereby the thickness of the wall plank is adjustable by selecting the dimension of said pair of films so as to tightly mate with an H-shaped steel beam.

* * * * *